United States Patent [19]

Magaha, Jr.

[11] Patent Number: 4,599,831

[45] Date of Patent: Jul. 15, 1986

[54] CEILING PANEL SECURITY CLIP DEVICE

[75] Inventor: George H. Magaha, Jr., Pasadena, Md.

[73] Assignee: Economy Distributors, Inc., Glen Burnie, Md.

[21] Appl. No.: 685,740

[22] Filed: Dec. 24, 1984

[51] Int. Cl.[4] ..... E04B 5/52

[52] U.S. Cl. ..... 52/98; 52/489

[58] Field of Search ..... 52/489, 499, 484, 764, 52/716, 98

[56] References Cited

U.S. PATENT DOCUMENTS 4,062,164 12/1977 Cousins ..... 52/489

4,452,021 6/1984 Anderson ..... 52/484

FOREIGN PATENT DOCUMENTS 622877 5/1949 United Kingdom ..... 52/764

*Primary Examiner*—John E. Murtagh

*Attorney, Agent, or Firm*—Leonard Bloom

[57] ABSTRACT

A device for securing ceiling panels to a T-bar support in which two clips are provided: one, a U-shaped panel clip for engaging an end portion of the ceiling panel; and two, a holding clip for snappingly engaging both the U-shaped panel clip and respective edge portions of the T-bar support. With this arrangement, the ceiling panel is secured to the T-bar support to deter intrusion into the room from the space above the ceiling panel, and should intrusion occur the holding clip is adapted to break and fall away, its absence indicating intrusion has taken place.

15 Claims, 13 Drawing Figures

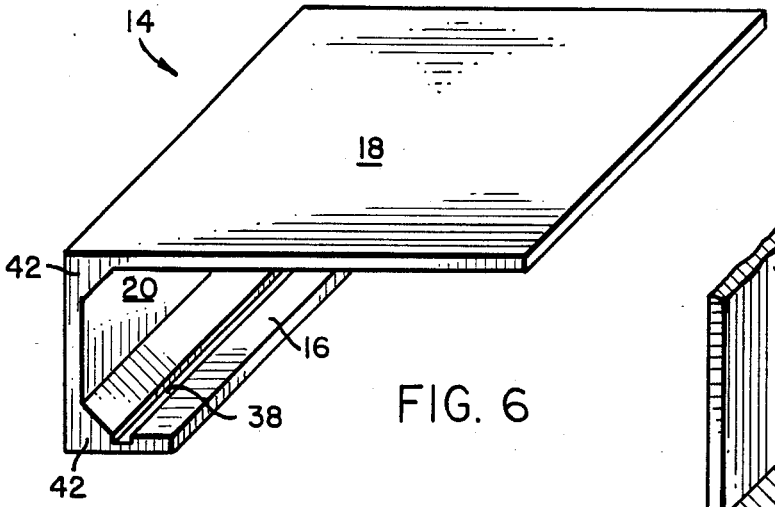
FIG. 6
FIG. 10
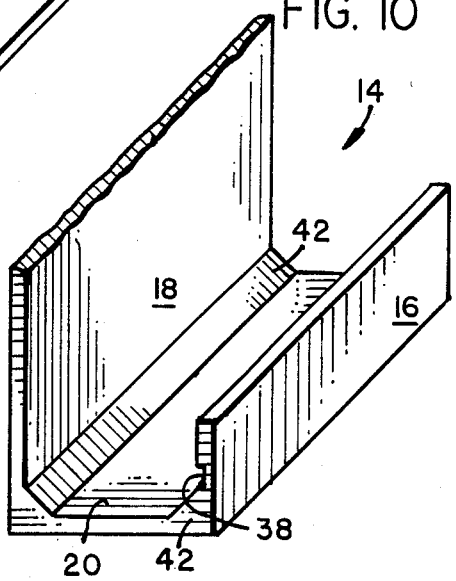
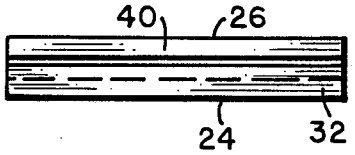
FIG. 8
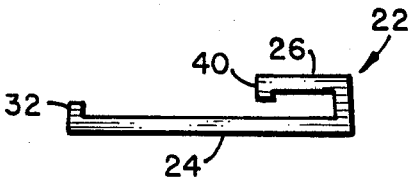
FIG. 7
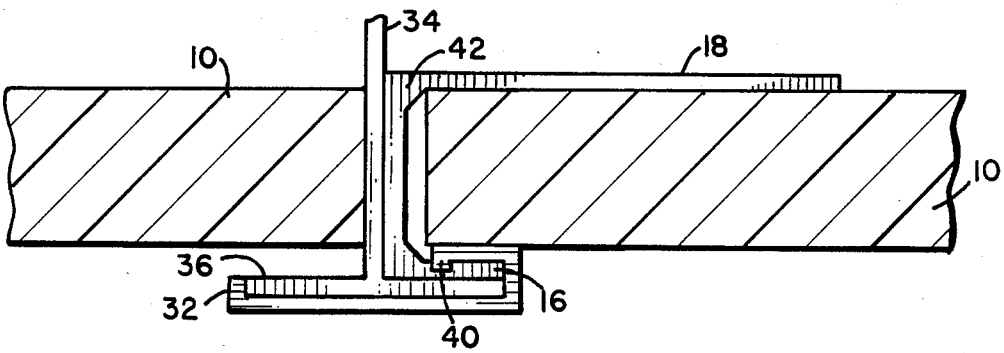
FIG. 9

CEILING PANEL SECURITY CLIP DEVICE

FIELD OF THE INVENTION

The present invention relates to ceiling panel security devices for use with suspended ceiling panels in conjunction with the conventional T-bar supports for such panels to thereby provide security for the space below the ceiling panels.

BACKGROUND OF THE INVENTION

In conventionally suspended ceiling construction, a known security device, as disclosed in U.S. Pat. No. 4,062,164, makes use of a U-shaped clip which engages around the edge of the ceiling panel and a turncatch pivotally attached to the clip which is rotated to a position where it engages under the T-bar so that the ceiling panel can be held in place. In this locking position, a screw is inserted through a suitable hole provided in the turncatch member and thus through the ceiling panel to thereby secure the turnlatch in its T-bar engaging position. Thus secured, the ceiling panel is prevented from being lifted out of its T-bar support without being visibly defaced. The foregoing security device, however, requires interrelated moving parts, for example, a pivotal means between the U-shaped clip and the turncatch member and a panel defacing means, namely, a screw securing the turncatch member into the ceiling panel. These various parts are costly to manufacture, requiring an in-place pivotal connection between the parts and, further, necessitating a change in the structural integrity of the panel.

SUMMARY OF THE INVENTION

The present invention serves to correct the aforementioned disadvantages by providing a security device which easily deters intrusion into a room space via a ceiling panel or panels by the simple use of a two-part snap-fit clip device that does not deface the ceiling panel.

Accordingly, it is a primary object of the invention to provide a simple security device for use with a ceiling tile or panel comprised of only two parts. Each part has a fixed construction and may comprise, for example, a stamping or moldment involving no moving parts. Each part is neat in appearance, not obtrusive, and may be readily removed and reused in different locations without damaging the panels. Ancilliary objects of the invention include the provision of a simple security clip device which will not deface the ceiling panel with which it is used either in the secure position, or, if intrusion does occur, in the intrusion-detected position. Further, the security clip according to the invention is simple and cost-efficient to manufacture, easy to install, and easy to replace, which facility renders it cost saving to the consumer.

More specifically, the invention provides a security clip device for use with ceiling panels to deter intrusion via such panels into the room space below in which a U-shaped clip having a long and a short leg made of either metal or plastic is received over the edge of a ceiling panel and is thereby lodged against the vertical member of the conventional T-shaped support for the ceiling panel. The U-shaped clip when in place provides a space or a pocket on the underside of the ceiling panel, i.e. the "ceiling" side, just above the horizontal ledge member of the T-bar. Into this space is inserted a second clip, constituting a holding or fastener clip, that slides into engagement with the U-shaped panel clip and has a portion thereof which is lodged between the bottom face of the panel and the shorter leg of the U-shaped panel clip. The holding clip comprises a main body portion, one end of which has an inturned shoulder, and the other end of which is folded back over a segment of its main body portion. In the locking position the folded over portion is received within the space formed between the shorter leg of the panel clip and the panel itself, while the shoulder of the holding clip engages the edge of the horizontal ledge or flange of the T-bar. Being flexible, the holding clip may be deflected and "snapped" into its locking position on to the panel clip. Consequently, lifting the ceiling panel for the purpose of intrusion will be resisted by the clip device. Should sufficient force be applied to lift the panel, the holding clip will likely break; and for each panel at least two if not four clips would have to be broken. A visual inspection will readily indicate that entry has taken place.

These and other objects of the present invention will become apparent from a reading of the following specification taken in conjunction with the enclosed drawings.

BRIEF DESCRIPTION OF THE DRAWINGS

FIG. 6 is perspective of the panel clip according to a further embodiment of the invention;

FIG. 7 is a side elevation of a holding clip used with the panel clip embodiment shown in FIG. 6;

FIG. 8 is a end elevation of the holding clip of FIG. 7;

FIG. 9 is a side elevation view of the security clip device shown in FIGS. 6 and 7 in place between a ceiling panel and the T-bar support therefor; and FIG. 10 is a partial perspective of the panel clip, inverted from the showing in FIG. 6.

GENERAL DESCRIPTION OF THE PREFERRED EMBODIMENT

Figure 1:
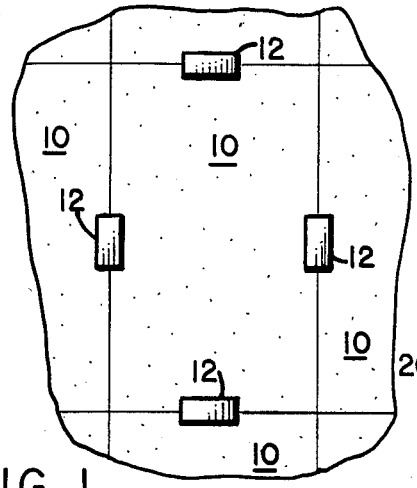
FIG. 1 is a schematic illustration showing a set of ceiling panels using a number of security clips according to the present invention.

Referring to FIG. 1, there is shown a member of ceiling tiles or panels 10 juxtaposed in the normal manner showing, also, the security clip devices 12 secured in place. Each panel 10 is shown having four clip devices for securing it to the associated T-bar support. Each of the devices 12 is shown adjacent a similar device for securing an adjacent panel. The devices 12 need not be positioned in the particular pattern shown, nor are four device required for each panel, since two of such devices placed in a generally opposite configuration, will suffice to secure the panel in place.

Figure 2:
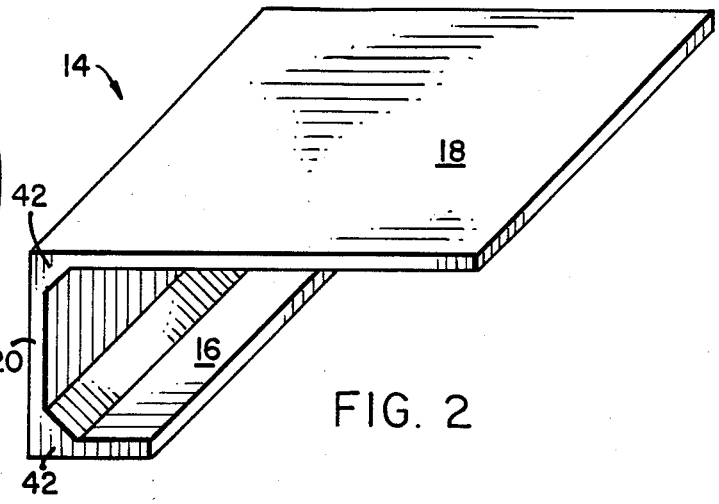
FIG. 2 is a partial perspective of a preferred embodiment of the panel clip portion of the invention.

In FIG. 2 the panel clip 14 is shown, which comprises a U-shaped channel member having a short leg portion 16, a long leg portion 18, and a connecting portion 20. A reinforcing segment 42 is also shown extending along each right angled portion. The panel clip 14 is constructed as a single piece and may be formed from a molded plastic or formed from sheet metal, as by a stamping process. The width of the U-shaped panel clip may be varied to accommodate various thickness of ceiling tiles or panels.

Figure 4:
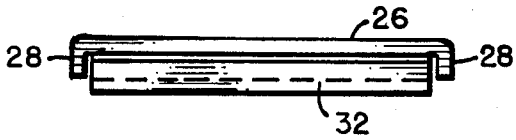
FIG. 4 is an end elevation of the holding clip shown in FIG. 3.
Figure 3:
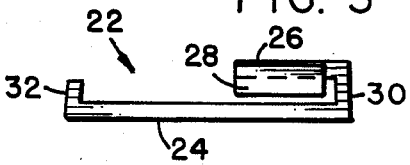
FIG. 3 is a side elevation of the holding clip portion of the invention.
Figure 3A:
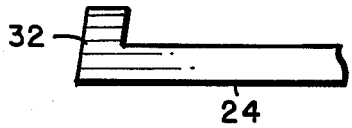
FIG. 3A is the left-hand portion of FIG. 3 drawn to an enlarged scale.
Figure 3C:
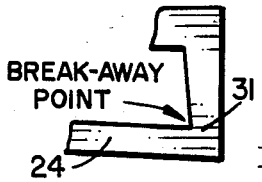
FIG. 3C corresponds to FIG. 3B, but shows an alternate embodiment having a reduced section incorporating a break-away point.
Figure 3B:
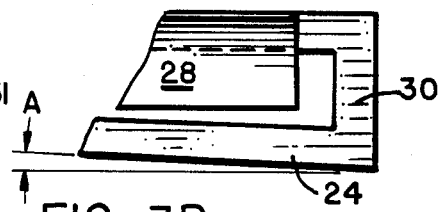
FIG. 3B is the right-hand portion of FIG. 3 drawn to an enlarged scale.
Figure 5:
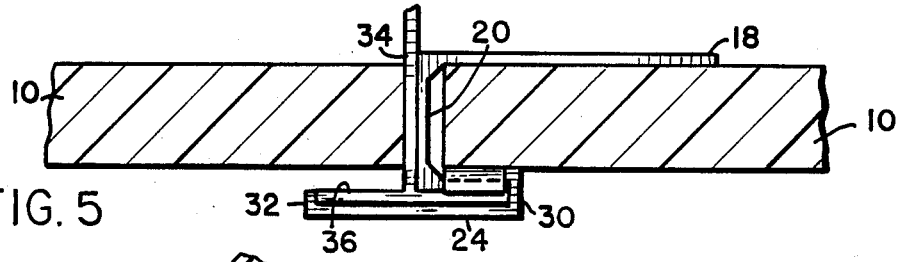
FIG. 5 is side elevation of the security clip device of the present invention, showing the panel clip and the holding clip removably secured between a ceiling panel and the T-bar support therefor.

The corresponding holding clip 22 is shown in FIGS. 3 and 4 and comprises a main body portion 24, one end of which is folded back over a segment of the body portion 24 and forms a flange 26. This latter member is provided with turned down side portions 28 which are adapted to contact the respective edges of the short leg of the panel clip 14, to be more fully described below. The main body portion 24 has an upstanding end portion 30 on one end thereof which is designed to clear the edge of the short leg 16 of panel clip 14, as best shown in FIG. 5. The other end of the body portion 24 comprises an upstanding end or stud member 32. In the enlarged views of FIGS. 3A and 3B, it will be seen that the end member 32 is slightly curved or bent inwardly in order to facilitate a snap-on or interference fit with the edge of the bottom horizontal flange on the inverted T-bar support, as best shown in FIG. 5. Also, the lower body portion 24 is shown to be inclined inwardly by an angle A, of about 5°, again, in order to facilitate a snap-on fit when assembled with the panel clip 14 and to provide resilient tension against the bottom of the T-bar support. Additionally, as shown in FIG. 3C, the end portion of the holding clip may be provided with a reduced cross-section 31 to provide an approximate break-away point. The holding clip is somewhat flexible and snaps over the bottom horizontal flange of the T-bar support, transversely thereof. Also, the flange 26 is weakest where it angles into the upstanding end portion 30 and defines that point where the device can break if forced upwardly.

Figure 5A:
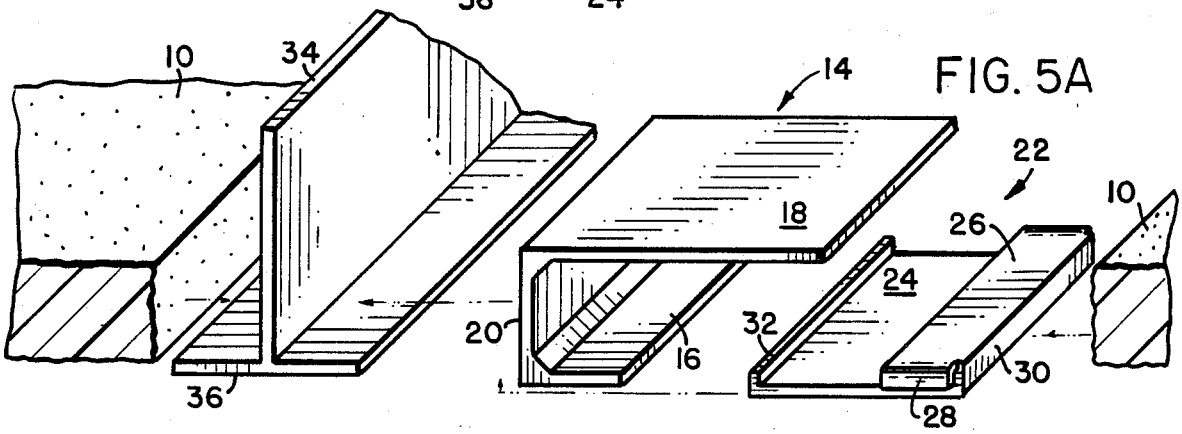
FIG. 5*a* is an exploded view of the embodiment shown in FIG. 5.

In FIGS. 5 and 5A, the two clips, panel clip 14 and holding clip 22, are shown assembled with respect to the panel 10 and a suitable T-bar support 34, of known design. It will be seen that the portion 20 of the panel clip 14 is slightly greater in length than the thickness of the panel 10 so that a small space is provided between the inside face of the short leg member 16 (constituting a lower portion of the panel clip) and the panel face constituting the ceiling of the room or other enclosure. The flange portion 26 of the holding clip 22 fits into this space, thereby wedging the leg 16 of the panel clip, and thereby securing the panel to the T-bar support. The downwardly extending side portions 28 of the fastener clip extend over the respective edges of the short leg member 16, thus preventing the panel clip and the fastener clip from sliding in a lateral or transverse direction therebetween (longitudinally of the T-bar support). The end stud member 32 of the holding clip 22 engages the edge portion of the horizontal ledge 36 of the T-bar 34, as shown, the same as the upstanding end portion 30 of the holding clip 22 engages both the edge of the ledge 36 and the edge of the short leg member 16.

In FIGS. 6–9 a further embodiment of the invention is shown wherein similar parts to those previously described are affixed with the same numerals. As shown in FIG. 6 the short leg member 16 of the U-shaped panel clip is provided with a channel 38 extending the length of the leg member and running parallel with the folds therein. Cooperating with the channel 38, and as best shown in FIGS. 7 and 8, is an inturned longitudinal rib 40 on the flange 26 which engages the channel to form a detent locking engagement, as best shown in FIG. 9. As will be seen, the other parts of the holding clip function in the same manner as that previously described. Again, being flexible the holding clip 22 easily snaps into place with the inturned longitudinal rib 40 forming a detent locking engagement with the channel 38 in the panel clip.

In FIG. 10, there is shown in greater detail the reinforcing sections 42 which can be part of the molding process if the member 14 is molded from plastic, or if the member is composed of sheet metal, stubs or lugs can be welded to the device in the same general area. The reinforcement feature provides added strength to prevent breaking of the security clip 12 and also serves to grip the edges of the panel 10, preventing lateral movement thereof. This feature further insures that it will be the holding clip 22 which will break should forced entry occur.

Once the security devices 12 are snapped into place as shown in FIG. 1, and the panels 10 are thereby secured to their respective T-bar supports 34, the panels 10 are thus rendered resistant to movement in an upward direction, away from the T-bar supports and towards the space above the ceiling. Any attempt to remove the panel 10 for the purpose of intruding into the room space below the panel will be met with resistance—which may be considerable if metal security clips are used and less considerable if plastic clips are used. In the case of the latter about a 5 lb. pull is required to snap or break the holding clips 22. If such becomes the case and entry by stealth into the room space below is achieved, that entry or intrusion can be later detected (assuming there are no obvious signs of intrusion, such as interior damage and theft) by merely observing the absence of holding clips 22 on the ceiling panels.

It will be seen from the above-detailed description that a simple security clip device has been provided which involves no moving parts and which is simply constructed from molded or stamped parts, easily installed and, if subsequently broken, easily replaced.

It is to be understood that the foregoing discussion and accompanying illustrations have been set out by way of example and not by way of limitation. Accordingly, within the scope of the appended claims, numerous other embodiments and variants are possible within the spirit of the present invention.

I claim:

1. A security device for securing a respective ceiling panel to a framework support therefor, wherein the support includes a substantially horizontal flange member having respective longitudinal side edges, one of which is disposed beneath the respective ceiling panel, and the other of which is remote from the respective ceiling panel, and wherein the panel has a bottom face, comprising a clip-on means for removably engaging an edge portion of said respective ceiling panel in the vicinity of said framework support, a removable holding means completely separate from the clip-on means and engaging a portion of said clip-on means and at least the other remote edge of said framework support with an interference fit therebetween, thereby securing said clip-on means to said framework, and the holding means including flange means wedged between the bottom face of the panel and the horizontal flange member on the support.

2. A security device seconding to claim 1, wherein said framework support comprises a T-bar support member, and said holding means comprises pliable portions thereon for effecting a snap-on fit with said T-bar support.

3. A security device according to claim 2, wherein said pliable portions on said holding means comprise spaced apart upstanding end portions slightly inclined towards one another for engaging respective edges of said T-bar support.

4. A security device according to claim 1, wherein said clip-on means and said holding means are composed of a molded plastic.

5. A security device according to claim 1, wherein said clip-on means and said holding means are composed of a sheet metal material.

6. A security device according to claim 1, wherein said clip-on means and said holding means are pliable and are composed of a similar material.

7. A security device according to claim 1, wherein said clip-on means comprises a U-shaped member having a reinforcing means and one leg thereof shorter than the other, the legs of said U-shaped member straddling said edge portion of said panel.

8. A security device for securing a ceiling panel to a framework support therefor, comprising a clip-on means for removably engaging an edge portion of said ceiling panel in the vicinity of said framework support, and a holding means engaging a portion of said clip-on means and at least one edge of said framework support, for securing said clip-on means to said framework support, wherein said holding means includes turned down side portions extending along respective edges of said clip-on means for preventing lateral movement of said holding means with respect to said clip-on means.

9. A security device for securing a ceiling panel to a framework support therefor, comprising a clip-on means for removably engaging an edge portion of said ceiling panel in the vicinity of said framework support, and a holding means engaging a portion of said clip-on means and at least one edge of said framework support, for securing said clip-on means to said framework support, wherein said holding means includes a rib portion for engaging a channel means provided in said clip-on means.

10. A security device for securing a ceiling panel to a framework support therefor, comprising a clip-on means for removably engaging an edge portion of said ceiling panel in the vicinity of said framework support, and a holding means engaging a portion of said clip-on means and at least one edge of said framework support, for securing said clip-on means to said framework support, wherein said clip-on means comprises a U-shaped member having a reinforcing means and one leg thereof shorter than the other, the legs of said U-shaped member straddling said edge portion of said panel, and, wherein said holding means comprises a main body portion and a flange portion folded over said main body portion and providing a space therebetween for receiving said shorter leg of said U-shaped member, said holding means adapted to break with a given amount of force applied to said panel.

11. A security device according to claim 10, further including a break-away point on the holding means.

12. A security device for securing a ceiling panel to a T-bar framework support therefor, said T-bar support having respective horizontal and vertical members, comprising a U-shaped panel clip engaging an edge portion of said ceiling panel in the vicinity of the vertical member of said T-bar support, and a holding clip having a space defined by a flange portion thereof and a main body portion thereof for receiving one of the leg members of said U-shaped clip-on member, said holding clip further having pliable edge portions for snapping on to the respective edge portions of the horizontal member of said T-bar support for securing said U-shaped panel clip and hence said T-bar support, and further being adapted to break along a portion thereof upon the application of sufficient force to said panel.

13. A security device for securing a respective ceiling panel to a T-bar framework support therefor, wherein the support includes a substantially horizontal flange member having respective longitudinal side edges, one of which is disposed beneath the respective ceiling panel, and the other of which is remote from the respective ceiling panel, comprising a clip-on means engaging an edge portion of said panel in the vicinity of said T-bar support, the clip-on means comprising a U-shaped member straddling the panel and including a long leg on top of the panel and a short leg beneath the panel, and a separable holding means engaging the respective longitudinal side edges of the horizontal flange member of said T-bar support and further having a flange portion engaging between the panel and the short leg of said clip-on member for removably securing said clip-on member to said T-bar support.

14. A security clip for a removable ceiling panel, wherein the panel normally rests upon one of the bottom horizontal flanges for an inverted T-bar support for the ceiling, comprising a U-shaped panel clip removably straddling an end portion of the panel and having a lower portion disposed below the bottom face of the panel, and a holding clip having a portion slidably wedged between the lower portion of the panel clip and the bottom face of the panel, the holding clip further having respective portions engaging the side edges of the respective flanges of the support and providing an interference fit therebetween, the arrangement being such that the panel clip may be received over the panel, the panel may be lowered on to the flange of the support, and the holding clip may be slidably snapped over the flange to secure the panel thereto.

15. A security clip for a removable ceiling panel, wherein the panel normally rests upon one of the bottom horizontal flanges of an inverted T-bar support for the ceiling, comprising a panel clip carried by the panel and having a lower portion disposed below the bottom face of the panel and spaced therefrom, a holding clip completely separate from the panel clip and slidably and removably snapped over the bottom flange of the support transversely thereof, flange means on the holding clip and disposed in the space between the bottom face of the panel and the lower portion of the panel clip for wedging the lower portion of the panel clip against the flange on the support in a direction transverse to the plane of the panel, thereby retaining the panel to the support, and means cooperating between the panel clip and the holding clip for precluding substantial movement therebetween in a direction generally longitudinally of the support.

* * * * *